US005427318A

United States Patent [19]

Lee

[11] Patent Number: 5,427,318

[45] Date of Patent: Jun. 27, 1995

[54] ONE-TOUCH ON-OFF SHOWERHEAD VALVE

[76] Inventor: Duck S. Lee, 504-21 Shinlim4-dong, Kwanak-gu, Seoul, Rep. of Korea

[21] Appl. No.: 179,160

[22] Filed: Jan. 10, 1994

[30] Foreign Application Priority Data

Jan. 13, 1993 [KR] Rep. of Korea ..... 93-414
Aug. 14, 1993 [KR] Rep. of Korea ..... 93-15647

[51] Int. Cl.[6] ..... B05B 1/30

[52] U.S. Cl. ..... 239/533.15; 239/569; 239/570; 239/562; 251/243

[58] Field of Search ..... 239/569, 570, 577, 533.1, 239/533.15, 552, 553.5, 562, 446, 448, 449, 435; 251/39, 243

[56] References Cited

U.S. PATENT DOCUMENTS

| | | | |
|---|---|---|---|
| 2,583,233 | 1/1952 | Russell | 239/570 |
| 2,789,011 | 4/1957 | Gebauer | 239/569 |
| 3,637,143 | 1/1972 | Shanes et al. | 239/577 |
| 4,629,124 | 12/1986 | Gruber | 239/562 |

*Primary Examiner*—Karen B. Merritt
*Attorney, Agent, or Firm*—Morgan & Finnegan

[57] ABSTRACT

A one-touch on-off showerhead valve apparatus for controlling the flow of fluid by pushbutton operation that includes a body having an inner cavity which is divided into first, second and third spaces by a bellows and a support plate mounted therein. The bellows defines a first flow path to permit fluid entering the apparatus to flow between the first and second spaces. A spool fixed to and penetrating both the support plate and bellows defines a second flow path having a diameter larger than the first flow path which permits fluid to flow between the second and third spaces. A valve connected to the pushbutton selectively permits fluid to flow through the second flow path. A third flow path is formed in the support plate that permits fluid to flow between the first and third spaces. When the second flow path is normally closed by the valve, the bellows blocks the third flow path preventing fluid from flowing into the third space and out of the apparatus. When the second flow path is selectively opened upon depression of the pushbutton, fluid flows from the second space to the third space through the second flow path. The fluid pressure in the third space becomes greater than that of the second space, thereby causing the bellows to uncover the third flow path and fluid flows between the first and third spaces and out of the apparatus.

13 Claims, 7 Drawing Sheets

ONE-TOUCH ON-OFF SHOWERHEAD VALVE

FIELD OF THE INVENTION

The present invention relates to a one-touch on-off valve which controls the flow of a fluid by pressing a button, and more particularly, to a one-touch on-off valve which controls the flow of a fluid by using pressure difference of the fluid in the valve case so as to operate a bellows.

BACKGROUND OF THE INVENTION

Generally, a rotary type on-off valve is used as a valve which controls the flow of the water in a kitchen, bathroom, etc. In such a rotary type on-off valve, a user manipulates an on-off valve switch to connect or disconnect the water. Thus, it is inconvenient for the user to operate the on-off valve switch for controlling the flow of the water. Also, the life cycle of the valve is shortened due to wear of the valve switch according to rotation of the valve switch.

In particular, a shower apparatus has no independent function of controlling the flow of the water therein. Instead, the shower apparatus is connected to a water faucet via a hose, and the flow of the water in the shower apparatus is controlled by manipulating a cock valve switch.

SUMMARY OF THE INVENTION

Therefore, to solve the above problems, it is an object of the present invention to provide a one-touch on-off valve apparatus which controls the flow of a fluid by using pressure difference of the fluid in the valve case, having easy manipulative and semi-perpetual characteristics.

Another object of the present invention is to provide a one-touch on-off valve apparatus which can be adopted in a shower apparatus.

To accomplish the above object of the present invention, there is provided a one-touch on-off valve apparatus comprising: 'a body in which a predetermined space is formed and on which an inlet for receiving fluid from a fluid supply source thereinto is formed; a bellows which is accommodated in the body and installed so as to divide the inner space of the body into a first space and a second space, and in which at least one first flow path for receiving the fluid from the first space, which communicates with the inlet to the second space; a bellows supporter which is closely connected to the bellows, having a second flow path which is formed between the second space and a third space penetrating the bellows from a substantially central portion, and a third flow path which is formed between the first space and the third space when the bellows is departed off over the second space according to the pressure difference between the first and second spaces, and which is fixed to the body; and an on-off valve which is installed through the body so as to be externally operable, the on-off valve making the second flow path open by pressing an externally protruded edge portion and making the second flow path closed by releasing the edge portion.

It is preferable that the body further include a cover portion on which a plurality of holes are formed for minutely separating and externally discharging the fluid in the third space.

The valve apparatus according to the present invention can be applied to a shower apparatus by substituting the head of the shower apparatus with the body.

DETAILED DESCRIPTION OF THE PREFERRED EMBODIMENT

Hereinbelow, a preferred embodiment of the present invention will be described in detail with reference to the accompanying drawings.

Figure 1:
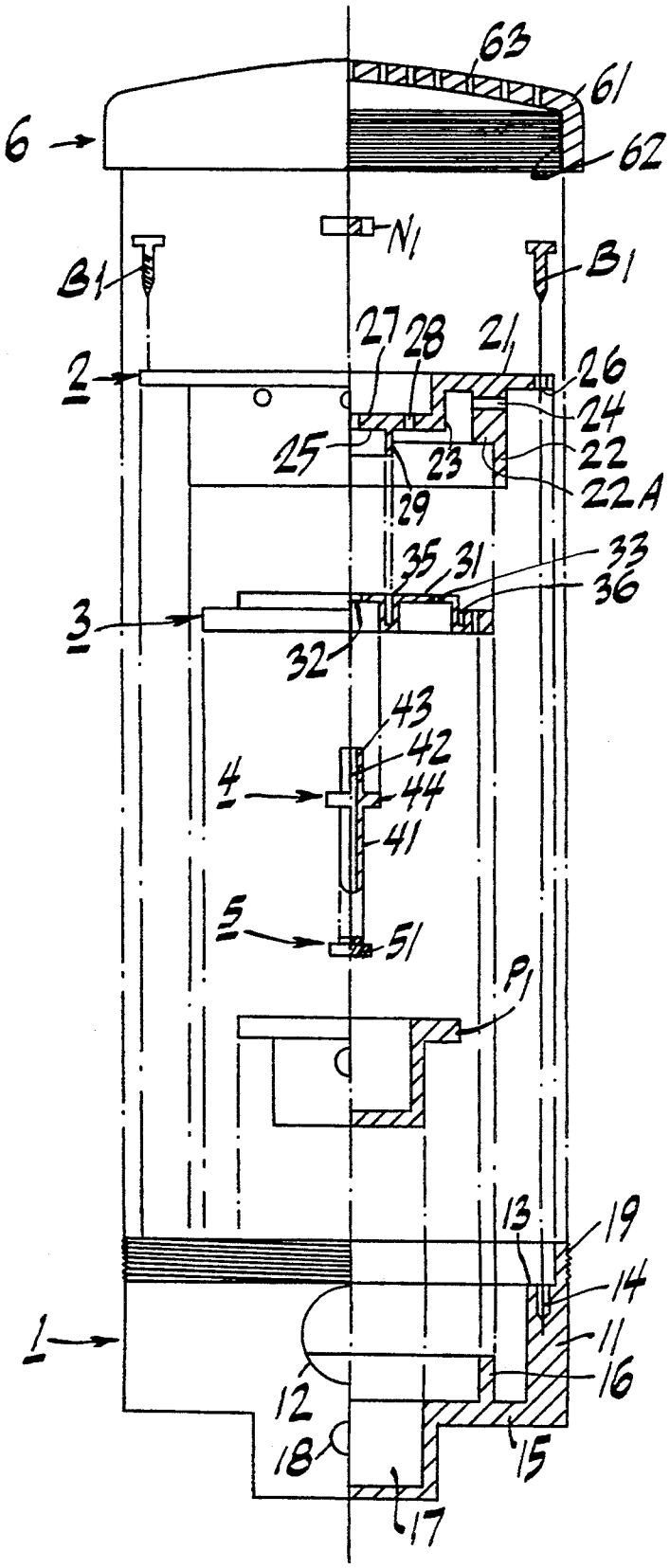
FIG. 1 is an exploded perspective view of a one-touch on-off valve apparatus according to the present invention.

FIG. 1 is an exploded perspective view of a one-touch on-off valve apparatus according to the present invention. As shown in FIG. 1, the one-touch on-off valve apparatus according to the present invention includes a valve portion 1, a support plate 2, a bellows 3, a spool 4, an on-off valve 5 and a cover portion 6.

Valve portion 1 has a cylindrical valve body 11 and an inlet 12 for receiving the water from a water supply source (not shown). A support plate mounting portion 13 for mounting support plate 2 in an opening state is formed on an inner upper circumferential surface of valve body 11. A nut groove 14 is formed in support plate mounting portion 13. On the other hand, a thread portion 19 is formed in an outer upper circumferential surface of the valve body 11 so as to engage cover portion 6. A bottom plate 15 is formed in the lower portion of valve body 11. A bellows seat 16 for supporting bellows 3 is formed on bottom plate 15. An on-off valve chamber 17 is formed in the central lower portion of bottom plate 15. A hole 18 is formed in a portion of on-off valve chamber 17. An on-off valve 5 is installed via hole 18. One end of on-off valve 5 is installed so as to open and close the flow path of spool 4, while the other end thereof is connected to an operating button (not shown).

Support plate 2 includes a circular plate body 21 of which the lower portion has a first cylindrical body 22 having a relatively larger diameter and a second cylindrical body 23 having a relatively smaller diameter. Circular plate body 21 includes at least two connection holes 26 formed on the peripheral portions thereof, through which connection means B1 is threadedly engaged. Also, circular plate body 21 includes an assembly hole 25 formed on the central portion thereof, through which spool 4 is inserted. Flow paths 24 are formed on the upper portion of first cylindrical body 22 in a radius pattern according to a proper interval, so that the water can be communicated between the inner portion and the outer portion of first cylindrical body 22. A first bellows seat 22A for contacting the upper surface of bellows 3 is formed on the inner lower circumferential surface. On the lower portion of second cylindrical body 23 is formed a bottom plate 27. Flow paths 28 are formed along the circumferential surface of bottom plate 27 so that the water can communicate therethrough. Also, on the lower surface of bottom plate 27 is formed a second bellows seat 29 which is inserted into a fixing groove 35 of bellows 3.

Bellows 3 moves up and down according to the pressure difference of the fluid contacting the opposite surfaces of the bellows (see FIGS. *7a–7c* and description herein) and performs the functions of opening and closing of flow paths 28. Bellows body 31 is made of a rubber material having an excellent elasticity. On the central portion of bellows body 31 is formed an assembly hole 32 into which spool 4 is inserted. Small flow paths 33 are formed spaced from assembly hole 32 by a predetermined distance, so that the water can communicate between the upper surface and the lower surface of bellows body 31. A curved portion 36 is formed in bellows body 31. As a result, bellows body 31 can easily move up and down.

Spool 4 fixes bellows 3 on support plate 2 and provides flow paths between valve portion 1 and the upper surface of support plate 2. Spool body 41 is made of a strong material. A lengthwise flow path 42 is formed in the center portion of spool body 41. A thread portion 43 is formed on the outer upper circumferential surface of spool body 41 so as to be engaged with a nut $N_1$. On the lower portion of thread portion 43 is formed a stopper 44.

Figure 3:
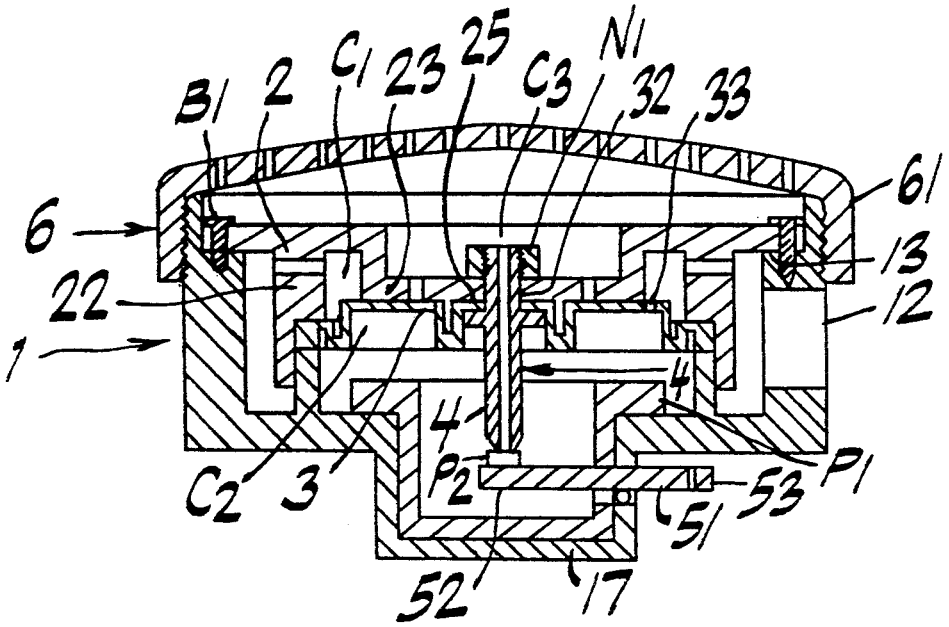
FIG. 3 is a side cross-sectional view of the assembled FIG. 1 apparatus.

On-off valve 5 opens and closes flow path 42 of spool 4. An on-off valve body 51 is constituted as a lever type. Thus, as shown in FIG. 3, one end 52 of on-off valve body 51 is positioned on an end of spool 4 so as to open or close flow path 42 of spool 4, while the other end 53 thereof is connected to an operating unit 7 (FIG.4) for enabling one end 52 of on-off valve body 51 to move up and down. Operating unit 7 is enough if it is designed so that on-off valve 5 can move up and down.

Cover portion 6 covers the assembled valve elements, and includes a cover body 61. On the inner circumferential surface of cover body 61 is formed a thread portion 62 so as to be threadedly engaged with thread portion 19 of valve portion 1. On cover body 61 are formed one or more outlets 63. A reference symbol P1 designates a packing.

Figure 2:
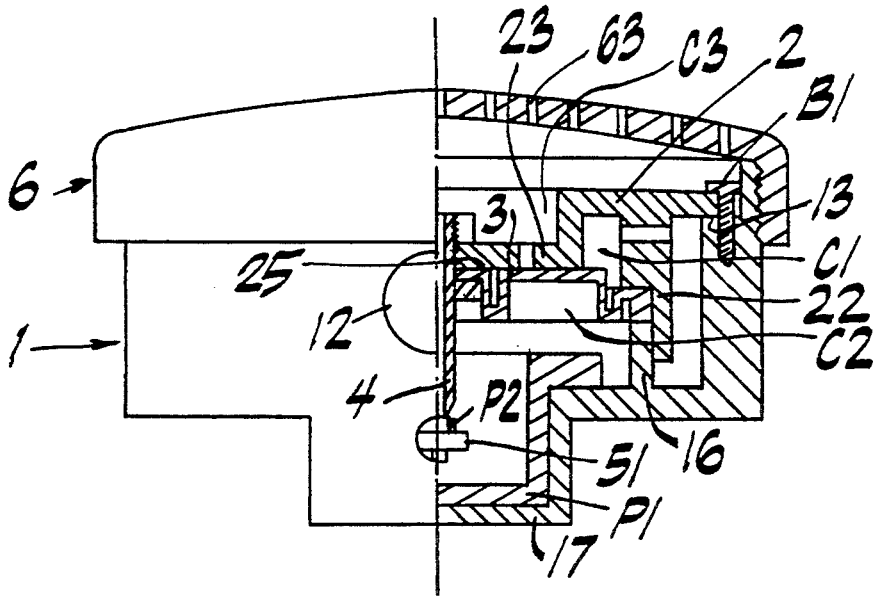
FIG. 2 is a front cross-sectional view of the assembled FIG. 1 apparatus.

FIGS. 2 and 3 are cross-sectional views of the valve apparatus obtained by assembling the respective elements shown in FIG. 1. FIG. 2 is a cross-sectional view of the valve apparatus in which inlet 12 is seen in its front. FIG. 3 is a cross-sectional view of the valve apparatus in which inlet 12 is seen in its side. Bellows 3 is assembled to the lower portions of first and second cylindrical bodies 22 and 23 in support plate 2. Spool 4 is inserted into assembly hole 32 of bellows 3 and assembly hole 25 of support plate 2 so as to be assembled with each other. Then, spool 4 is engaged with nut $N_1$. On-off valve 5 is assembled together with packing P1 in on-off valve chamber 17 of valve portion 1. Then, support plate 2 is fixed to support plate mounting portion 13 with connection bolts B1. Then, cover portion 6 is fixed to valve portion 1. In this manner, assembly of the one-touch on-off valve apparatus according to the present invention is accomplished.

In such an assembled valve apparatus are formed portions for stopping or moving the flow of the water. An inlet chamber C1 is formed between support plate 2 and bellows 3. A distribution chamber C2 is formed between bellows 3 and valve portion 1. An outlet chamber C3 is formed between support plate 2 and cover portion 6. Such a valve apparatus can be connected to a faucet or a shower apparatus, or can be incorporated therein.

Figure 4:
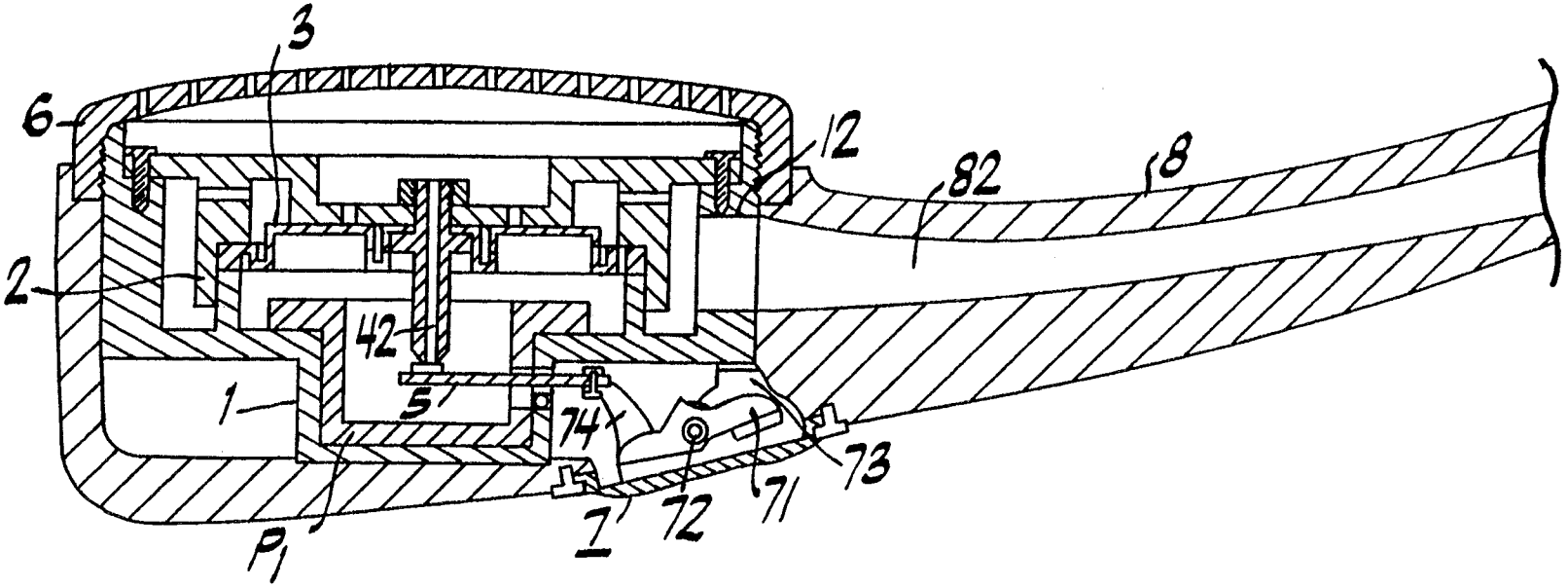
FIG. 4 is a cross-sectional view of a shower apparatus in which a one-touch on-off valve according to the present invention is incorporated.

FIG. 4 is a cross-sectional view of a shower apparatus in which a one-touch on-off valve according to the present invention is incorporated. As seen from the drawing, when the valve is incorporated in a shower apparatus 8, an inlet 82 of shower apparatus 8 matches inlet 12 of valve portion 1, to then be assembled with each other. In this case, a button-type operating unit 7 for moving on-off valve 5 up and down is mounted in shower apparatus 8 as well. In operating unit 7, operating unit body 71 is rotatably fixed to a shaft pin 72 together with a spring 73. Operating unit body 71 is fixed to one end of a lever 74. The other end of lever 74 is connected to on-off valve 5, to thereby move operating unit body 71 clockwise or counterclockwise around shaft pin 72 to enable lever 74 to make on-off valve 5 open or close flow path 42.

Figure 5:
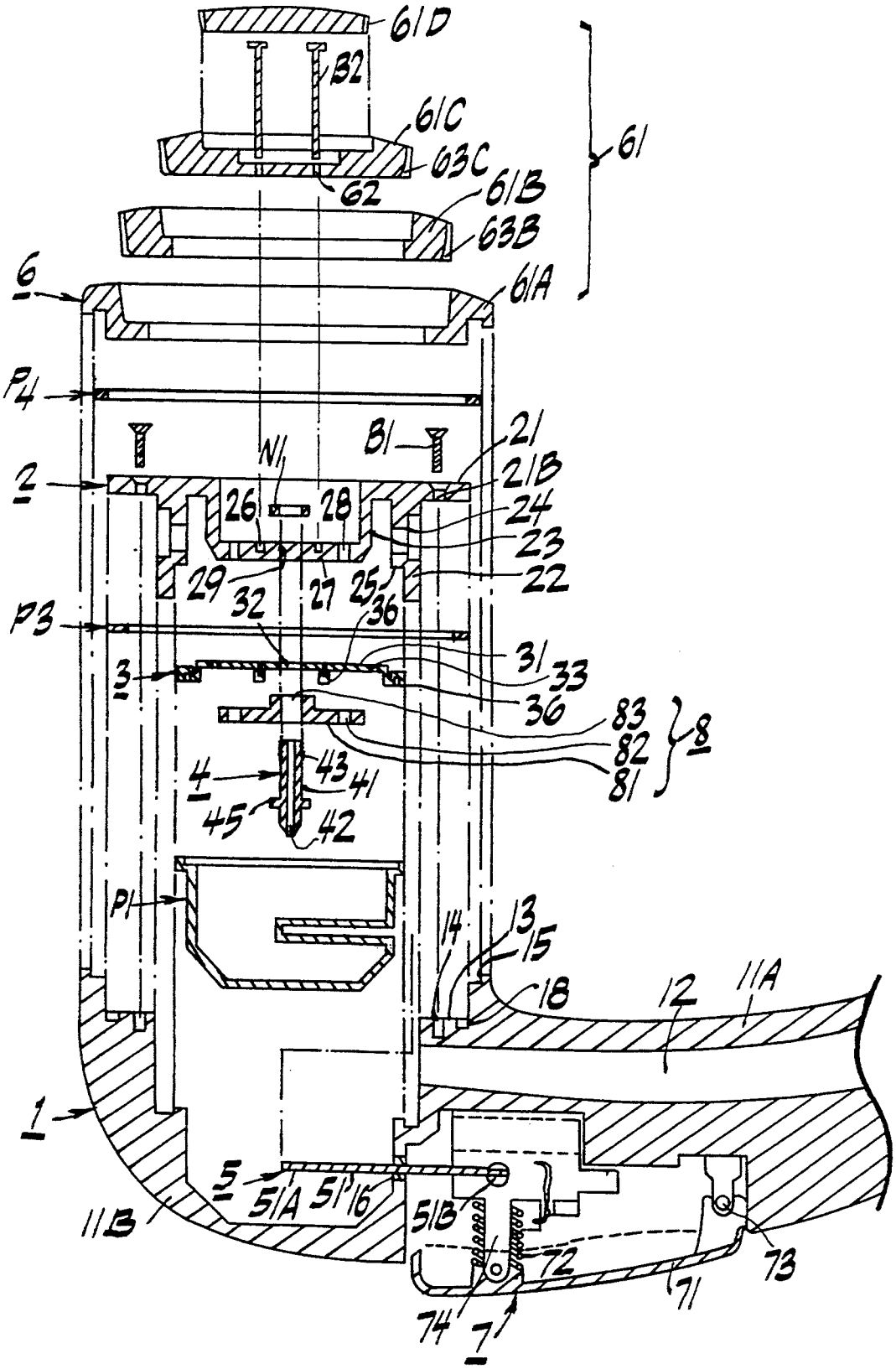
FIG. 5 is an exploded cross-sectional view of a one-touch on-off shower apparatus to which a valve apparatus according to the present invention is adopted.

FIG. 5 is an exploded cross-sectional view of a one-touch on-off shower apparatus to which a valve apparatus according to the present invention is adopted. In FIG. 5, the elements which perform the same functions as in FIG. 1 are designated with the same reference numerals and characters. The FIG. 5 apparatus will be described below in detail.

A shower apparatus 1 comprises a grip portion 11A handled by the user and a head portion 11B in which various valve components are accommodated and mounted. Grip portion 11A and head portion 11B are integrally formed as a similar shape to that of the existing shower apparatus. An inlet portion 12 is lengthwisely formed in the inner portion of grip portion 11A in order to receive the water from a water supply source (for example, a water hose which is connected to a faucet) and supply the received water into head portion 11B. In the inner portion of head portion 11B are formed spaces for accommodating the various valve components. That is, on the inner upper circumferential surface of head portion 11B are formed a support plate mounting portion 13 for mounting support plate 2 thereon and a cover mounting portion 15 for mounting cover portion 6 thereon. Nut groove 14 is formed in support plate mounting portion 13. On the lower portion of head portion 11B is formed a hole 16, into which on-off valve 5 is inserted to thereby be fixed together with a packing P1. A reference numeral 18 designates a packing seat.

In FIG. 5, support plate 2 comprises a substantially cylindrical plate body 21 through which connection holes 21B are formed. The plate body 21 is fixed to support plate mounting portion 13 in head body 11B by means of connection bolts B1 through connection holes 21B. The lower portion of plate body 21 has a first cylindrical body 22 having a predetermined diameter and a second cylindrical body 23 having a smaller diameter than that of first cylindrical body 22. Flow paths 24 are formed on first cylindrical body 22, so that the water flowing from inlet 12 can flow toward second cylindrical body 23. Bellows seats 25 are formed on the lower portion of first cylindrical body 22. Bellows seats 25 are connected to both ends of bellows 3.

On the lower portion of second cylindrical body 23 is formed a bottom plate 27. Flow paths 28 are formed along the circumferential surface of bottom plate 27 so that the water can communicate therethrough. Also, on the central portion of bottom plate 27 is formed a fixing hole 29 for inserting spool 4 thereinto and connection holes 26 for fixing connection bolts B2.

Bellows 3 moves up and down according to the pressure difference of the fluid contacting the opposite surfaces of the bellows (see FIGS. *7a–7c* and description herein) and performs the functions of opening and closing of flow paths 28. Bellows body 31 is made of a rubber material having an excellent elasticity and a shape of a thin film.

On the central portion of bellows body 31 is formed an assembly hole 32 into which spool 4 is inserted. Flow paths 33 having smaller diameters than those of spool flow path 42 are formed in the peripheral circumferential surface of bellows body 31, so that the water can communicate between the upper surface and the lower surface of bellows body 31 through flow paths 33.

Flow paths 33 can be formed as two or more flow paths 33 as necessary. However, the total amount of the water flowing through flow paths 33 should be less than that through flow path 42 which are formed on the inner central portion of spool 4. A curved portion 36 is formed in bellows body 31. As a result, bellows body 31 can easily move up and down.

Spool 4 fixes bellows 3 on support plate 2 and provides flow paths between valve portion 1 and the upper surface of support plate 2. Spool body 41 is made of a strong material and is formed as an elongated shape. A lengthwise flow path 42 is formed in the center portion of spool body 41. Here, the diameter of spool flow path 42 should be slightly larger than that of bellows flow path 33, so that the fluid amount flowing through spool flow path 42 is larger than that flowing through bellows flow or (the total flow paths, if the bellows flow paths are plural).

A thread portion 43 is formed on the outer upper circumferential surface of spool body 41. Thread portion 43 is engaged with a nut N1, thereby connecting spool 4 to support plate 2. A stopper 45 is formed on spool body 41.

On-off valve 5 opens and closes flow path 42 of spool 4. An on-off valve body 51 is constituted as a lever type. Thus, on-off valve body 51 comprises on-off portion 51A to open or close flow path 42 of spool 4 in one end of on-off valve body 51, and on-off operating portion 51B in which the other end of on-off valve body 51 is connected to an operating unit 7. Thus, operating unit 7 enables on-off operating portion 51B to move up and down, thereby moving on-off portion 51A up and down.

Operating unit 7 is enough if it is designed so that on-off valve 5 can move up and down so as to open and close the flow path of spool 4. In operating unit 7 which is employed in this embodiment, operating unit body 71 is mounted on spring 72 and hinge shaft 73. One end of operating unit body 71 is fixed to one end of lever 74. On-off operating portion 51B of on-off valve 5 is connected to the other end of lever 74. As a result, operating unit body 71 moves up and down, centered at hinge shaft 73, to thereby enable lever 74 to open and close on-off valve 5.

Cover portion 6 covers the valve elements assembled in shower head body 11B, and includes a cover body 61. Cover body 61 is formed of a plurality of separable bodies 61A–61D. To assemble cover body 61 to head body 11B, connection holes 62 are formed on separable body 61C. On the circumferential surfaces of separable bodies 61B and 61C in cover body 61 are formed one or more outlets 63B and 63C after these separable bodies 61B and 61C are combined with each other.

Reinforced plate 8 is fixed to spool 4 and is assembled to bellows 3 in a contact state, to prevent bellows 3 from being loose or damaged due to a long use. On reinforced plate body 81 are formed flow paths 82 and fixing hole 83 for fixing spool 4. Here, both reference symbols P3 and P4 designate packings.

Figure 6:
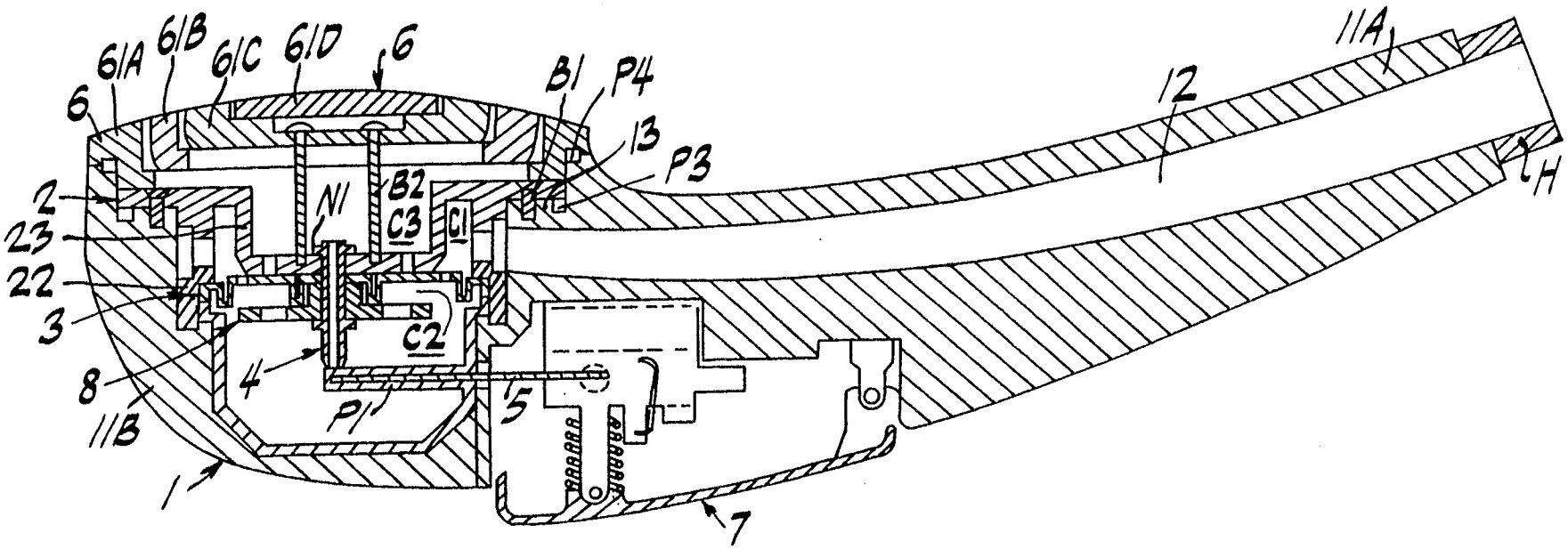
FIG. 6 is a front cross-sectional view of the assembled FIG. 5 apparatus.

FIG.6 is a front cross-sectional view of the assembled FIG. 5 apparatus. The assembly state of the shower to which the present invention is applied will be described in more detail with reference to FIG. 6.

Firstly, bellows 3 is fixed to first and second cylindrical bodies 22 and 23 of support plate 2, and reinforced plate 8 is fixed to spool 4. Then, spool 4 is inserted into assembly hole 32 of bellows 3 and assembly hole 29 of support plate 2, to then tighten with a nut N1.

On-off valve 5 is assembled in shower head body 11B together with packing P1. Support plate 2 is connected to support plate mounting portion 13 of shower head body 11B with connection bolts B1 together with packing P3. Finally, when cover portion 6 is connected to shower head body 11B, the assembly work of the shower apparatus is accomplished, to which the one-touch on-off valve according to the present invention is applied.

In such an assembled valve apparatus are formed portions for stopping or moving the flow of the water. An inlet chamber C1 is formed between support plate 2 and bellows 3. A distribution chamber C2 is formed between bellows 3 and shower head body 11B. An outlet chamber C3 is formed between support plate 2 and cover portion 6.

Figure 7A:
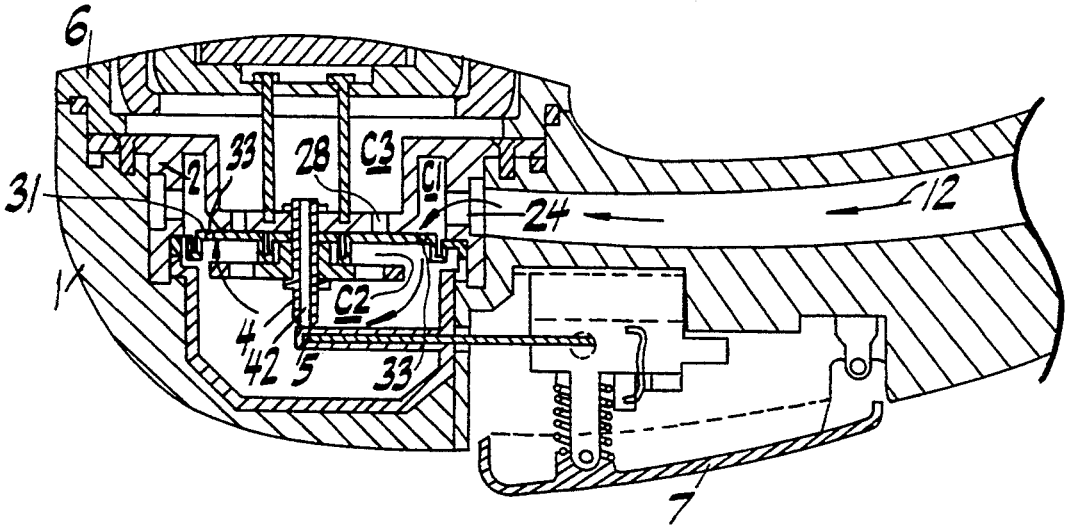
FIGS. 7A through 7C are views for explaining operation of the FIG. 5 apparatus according to the present invention.
Figure 7B:
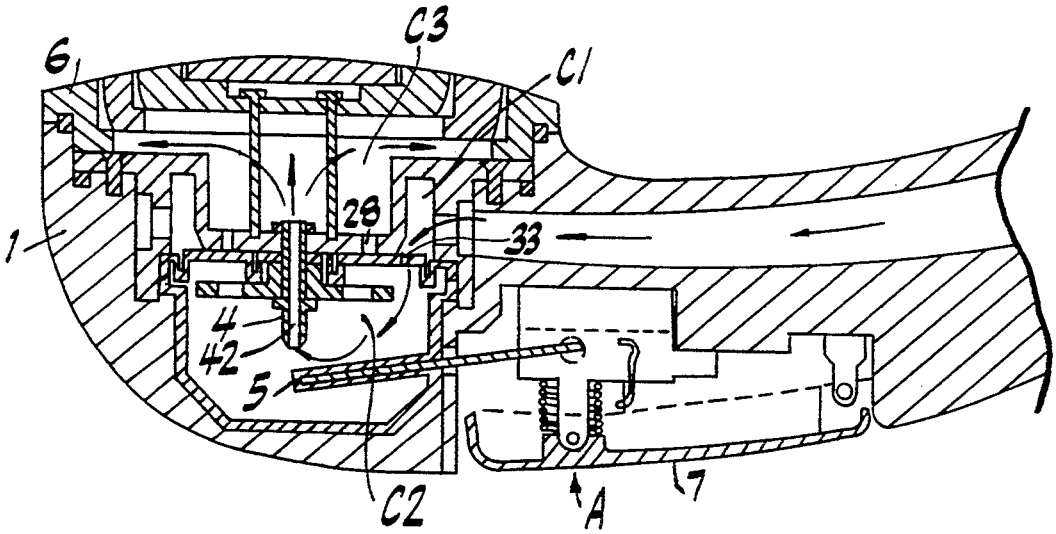
Figure 7C:
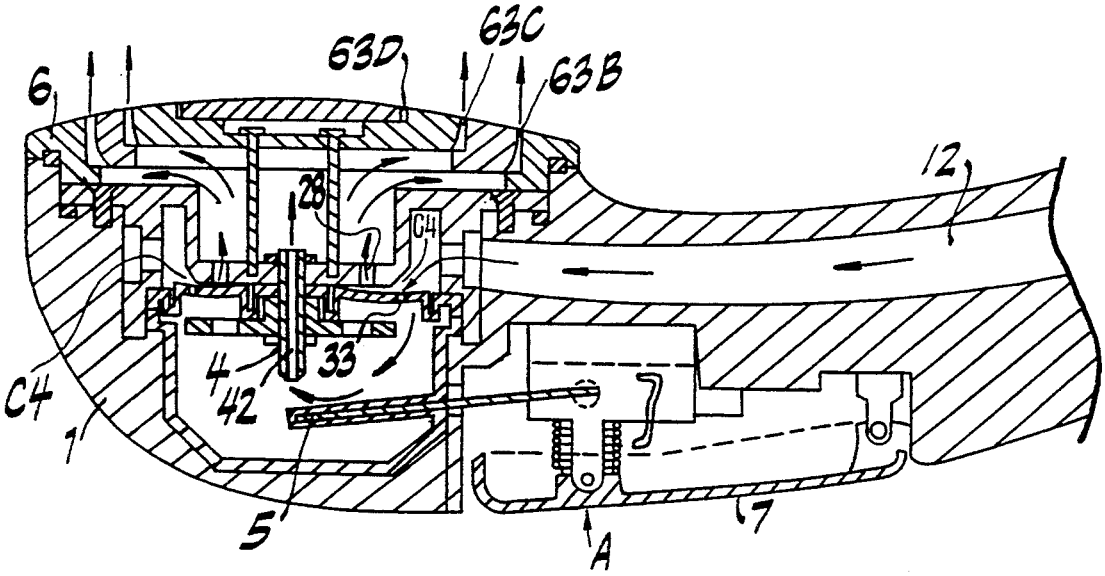

FIGS. 7A through 7C are views for explaining .operations of the shower adopting the one-touch on-off valve according to the present invention. Hereinbelow, the operation of the valve apparatus according to the present invention will be described with reference to FIGS. 7A through 7C.

Referring to FIG. 7A, if the shower apparatus is connected to a water supply source (not shown), the water flows through inlet 12 into the shower apparatus. Then, the water enters inlet chamber C1 along flow path 24 of support plate 2 from inlet 12. Then, the water entering inlet chamber C1 flows into distribution chamber C2 through flow paths 33 of bellows 3. In such a manner, if inlet chamber C1 and distribution chamber C2 are filled with the water, the water pressure in distribution chamber C2 is the same as that in inlet chamber C1 with respect to plate body 31 of bellows 3. Accordingly, bellows 3 is closely contacted to support plate 2, with the flow paths 28 of support plate 2 closed. As a result, the water does not flow in any direction.

Referring to FIG. 7B, if the user wants to use the water through the shower apparatus, the user should press operating unit 7 in a direction of an arrow A. Thus, on-off valve 5 which has been closing spool flow path 42, is lowered. Accordingly, spool flow path 42 is open. Therefore, the water in distribution chamber C2 flows toward outlet chamber C3 through spool flow path 42.

Referring to FIG. 7C, the water in inlet chamber C1 continuously flows toward distribution chamber C2 through bellows flow paths 33. However, since the diameters of bellows flow paths 33 is smaller than that of spool flow path 42, the amount of the water flowing toward distribution chamber C2 through bellows flow paths 33 is very small, but the amount of the water flowing toward outlet chamber C3 from distribution chamber C2 becomes large. Accordingly, the pressure in distribution chamber C2 becomes low. Thus, the pressure of the water in inlet chamber C1 directly influences the upper surface of bellows 3 to be pressed. Accordingly, the upper surface of body 31 of bellows 3 is departed from support plate 2. If the upper surface of body 31 of bellows 3 is departed from support plate 2, there becomes a predetermined gap C4 between the upper surface of bellows body 31 and support plate 12. Therefore, the water in inlet chamber C1 does not flow through small flow paths 33 of bellows 3, but flows directly toward support plate flow paths 28. Then, the water flows out of outlets 63B,63C and 63D through outlet chamber C3.

When the user wants to interrupt the water, the user releases his fingers, which have been pressing operating unit 7. In this case, operating unit body 71 is restored into an original position (the FIG. 7A position) according to the elastic force of spring 72. Thus, on-off portion 51A of on-off valve 5 closes spool flow path 42. Therefore, the water flow from distribution chamber C2 to outlet chamber C3 through spool flow path 42 is interrupted. Accordingly, the water in inlet chamber C1 flows toward distribution chamber C2 through fine flow paths 33 of bellows 3, to thereby incrementally increase the pressure in distribution chamber C2. Finally, if the pressure in distribution chamber C2 becomes the same as that in inlet chamber C1, bellows 3, which has been opening the support plate flow paths 28 spaced by a predetermined distance from support plate 2, is restored into an original position, to enable the upper surface of bellows body 31 to close support plate flow paths 28. Thus, the pressure in inlet chamber C1 is maintained in the same pressure as that of distribution chamber C2. Accordingly, the water does not flow between inlet chamber C1 and distribution chamber C2 any more and becomes still.

As described above, the valve apparatus according to the preferred embodiment of the present invention has been described with reference to the accompanying drawings. However, various modification and variation is possible within the scope of the appended claims without departing off the technical concepts of the present invention. For example, in the above embodiment, the separate spool is fixed to the support plate, but the spool and the support plate can be integrally formed when molding the support plate.

As described above, the valve apparatus according to the present invention can control the flow of the fluid using the pressure difference in the valve with an operation of the pushbutton. Thus, constitution of the valve is simple, lifetime of the valve is long and manipulation of the valve is convenient.

The valve apparatus according to the present invention can be applied to any fields of using valves which control the flow of the fluid. Particularly, the present invention can be effectively applied to shower apparatus.

What is claimed is:

1. A one-touch on-off valve apparatus comprising:

a body in which a predetermined space is formed and on which an inlet for receiving fluid from a fluid supply source is formed;

a bellows which is accommodated in said body and installed so as to divide the inner space of said body into a first space and a second space, and which defines a first flow path for receiving said fluid from the first space which communicates with said inlet to the second space;

a bellows supporter fixed to said body and closely connected to said bellows, the bellows supporter defining a second flow path which is formed between said second space and a third space penetrating said bellows from a substantially central portion, and defining a third flow path which is formed between said first space and said third space when said bellows is moved in a direction toward said second space according to the pressure difference between said first and second spaces; and an on-off valve which is installed through said body so as to be externally operable, said on-off valve opening said second flow path upon pressing an externally protruded edge portion and closing said second flow path by releasing said edge portion.

2. A one-touch on-off valve apparatus according to claim 1, further comprising a cover portion on which a plurality of holes are formed for minutely separating and externally discharging the fluid in said third space.

3. A one-touch on-off valve apparatus according to claim 2, wherein an operating unit which is combined to the externally protruded edge portion of said on-off valve is attached to an outer portion of said body.

4. A one-touch on-off valve apparatus according to claim 2, wherein the diameter of said second flow path is larger than the diameter of said first flow path.

5. A one-touch on-off valve apparatus according to claim 1, wherein said body comprises a head of a shower apparatus.

6. A one-touch on-off valve apparatus according to claim 5, wherein an operating unit which is combined to the externally protruded edge portion of said on-off valve is attached to an outer portion of said body.

7. A one-touch on-off valve apparatus according to claim 5, wherein the diameter of said second flow path is larger than the diameter of said first flow path.

8. A one-touch on-off valve apparatus according to claim 1, wherein an operating unit which is combined to the externally protruded edge portion of said on-off valve is attached to an outer portion of said body.

9. A one-touch on-off valve apparatus according to claim 1, wherein the diameter of said second flow path is larger than the diameter of said first flow path.

10. A one-touch on-off valve apparatus according to claim 1, wherein said bellows supporter comprises:

a support plate for closely combining said bellows therewith; and a spool which is installed by penetrating said support plate and said bellows, one end of said spool connected with said on-off valve and the other end of said spool protruding into said third space, said spool having said second flow path formed in a central portion thereof.

11. A one-touch on-off valve apparatus according to claim 10, wherein said bellows supporter further comprises a reinforced plate which is mounted to the spool in order to prevent said bellows from being damaged.

12. A one-touch on-off valve apparatus according to claim 1, wherein said bellows define a plurality of first flow paths for receiving said fluid from the first space which communicates with said inlet to the second space.

13. A one-touch on-off valve apparatus according to claim 12, wherein the diameter of said second flow path is larger than the total diameters of said first flow paths.

* * * * *